US006517384B2

(12) United States Patent
Murasawa et al.

(10) Patent No.: US 6,517,384 B2
(45) Date of Patent: Feb. 11, 2003

(54) CONNECTOR HAVING A REMOVABLE EMI FILTER

(75) Inventors: Osamu Murasawa, Tokyo (JP); Shinichi Aihara, Kanagawa (JP)

(73) Assignee: Sony Computer Entertainment, Inc., Tokyo (JP)

( * ) Notice: Subject to any disclaimer, the term of this patent is extended or adjusted under 35 U.S.C. 154(b) by 0 days.

(21) Appl. No.: 09/773,330

(22) Filed: Jan. 31, 2001

(65) Prior Publication Data

US 2001/0012728 A1 Aug. 9, 2001

(30) Foreign Application Priority Data

Feb. 4, 2000 (JP) ..... 2000-027899
Feb. 4, 2000 (JP) ..... 2000-027900

(51) Int. Cl.[7] ..... H01R 13/66; H01R 33/945
(52) U.S. Cl. ..... 439/620; 439/38
(58) Field of Search ..... 439/607, 620, 439/38

(56) References Cited

U.S. PATENT DOCUMENTS 4,583,810 A * 4/1986 Gliha, Jr. ..... 439/620
4,820,174 A * 4/1989 Farrar et al. ..... 439/620
5,397,250 A * 3/1995 Briones ..... 439/620
5,580,260 A 12/1996 Flieger
5,647,766 A * 7/1997 Nguyen ..... 439/620
5,770,984 A * 6/1998 Raleigh et al. ..... 333/185
5,838,216 A * 11/1998 White et al. ..... 333/182
6,252,163 B1 * 6/2001 Fujimori et al. ..... 439/620
2001/0006860 A1 * 7/2001 Nimura ..... 439/620

FOREIGN PATENT DOCUMENTS

| | | |
|---|---|---|
| DE | 93 14 667 | 3/1994 |
| GB | 2 278 740 | 12/1994 |
| JP | 1-140786 | 9/1989 |
| JP | 7-48427 | 5/1995 |

* cited by examiner

*Primary Examiner*—Khiem Nguyen
*Assistant Examiner*—Hae Moon Hyeon
(74) *Attorney, Agent, or Firm*—Katten Muchin Zavis Rosenman

(57) ABSTRACT

A connector has an insulating housing with a cutout in the side through which is inserted an EMI (Electromagnetic Interference) filter. Multiple signal transmission members are extended through said insulated housing with only selected transmission members piercing the EMI filter. Because only certain signal transmission members extend through the filter, EMI measures can be taken only in the part where voltage is impressed, and by not interposing the EMI filter between non-voltage bearing transmission members, the standard electric potentials can be made uniform.

15 Claims, 8 Drawing Sheets

CONNECTOR HAVING A REMOVABLE EMI FILTER

FIELD OF THE INVENTION

The present invention is directed to a connector and a method of manufacturing the same, and more specifically, to a connector having an insulating housing and an insertable EMI (Electromagnetic Interference) filter through which selected signal transmission members of a plurality of signal transmission members extend.

BACKGROUND OF THE INVENTION

Heretofore, in a connector that has an insulating housing and multiple signal transmission members that are inserted therethrough and whose conductors are electrically connected to each other, connectors have been used in which electromagnetic interference (EMI) measures are taken by causing signal transmission members to pierce a ferrite core, as shown, for example, with the connector described in unexamined utility model H1-140786 [1989]. In such prior art connectors, it is normally very difficult to form the housing and ferrite core by integral molding, so they are each manufactured separately, and during assembly the ferrite core is forcibly inserted into and mounted inside the housing, which makes manufacturing the connector more complicated.

In another prior art connector, the housing itself is formed by a ferrite core, and multiple connector pins that act as signal transmission members are inserted inside (as described in examined patent H7-48427 [1995]). With such a prior art connector, there is no need to separately provide ferrite pieces or other filter elements, and a connector having EMI measures can be made by a simple manufacturing process. Also, such a connector is suitable for power source lines in that adequate EMI measures can be applied. However, in such a structure the ferrite core acts as an impedance element provided on each connector pin. Therefore if such a connector is used as a connector for a DC power source that consists of voltage impression wires and grounding wires, the problem arises that a ferrite core will also be provided on the grounding wire part, for which no EMI measures actually need to be taken, and because this ferrite core will act as an impedance element, a standard electric potential will arise between conductors connected by the grounding wires, and it becomes difficult to make uniform the standard electric potentials of all the conductors connected by the grounding wires.

OBJECTS OF THE INVENTION

It is an object of the present invention, therefore, to provide a connector in which an EMI filter is arranged according to the electrical signals that flow along the signal lines.

It is a further object of the present invention to provide a connector in which selected signal transmission members extend through an EMI filter and selected signal transmission members do not.

It is a still further object of the present invention to provide a connector that can be manufactured with a drop-insertable EMI filter.

Still other objects and advantages of the invention will become clear upon review of the following detailed description in conjunction with the appended drawings.

SUMMARY OF THE INVENTION

A connector is provided with an insulating housing and multiple signal transmission members that are inserted through said housing. The signal transmission members are arranged parallel to a direction that is perpendicular to the direction in which they are inserted through said insulating housing, and formed in said insulating housing is a core insertion part into which is inserted an EMI filter or a ferrite core that is pierced by at least some of the signal transmission members among said multiple transmission members. Thus, the signal transmission members that pierce the ferrite core may be signal lines along which electrical signals flow, and the signal transmission members that do not pierce the ferrite core may be grounding wires or the like. Thus, it is possible to prevent the ferrite core from also acting as an impedance element on the grounding wires.

A method of manufacturing the connector is also provided, where the EMI filter or ferrite core may be simply inserted or dropped into the core insertion part of the insulating housing, which is easier to manufacture than if the ferrite core needed to be forcibly inserted. It is desirable that the cross-section of the core insertion part be concave, so that the EMI filter or ferrite core can be easily seated within such insertion part. Also, by inserting a plurality of signal transmission members through the insulating housing and by causing select transmission lines to pierce the ferrite core after the ferrite core has been inserted into the core insertion part, it becomes possible to securely fix said ferrite core in its prescribed position, without the ferrite core becoming dislodged from the core insertion part.

DETAILED DESCRIPTION OF THE PREFERRED EMBODIMENTS

Figure 1:
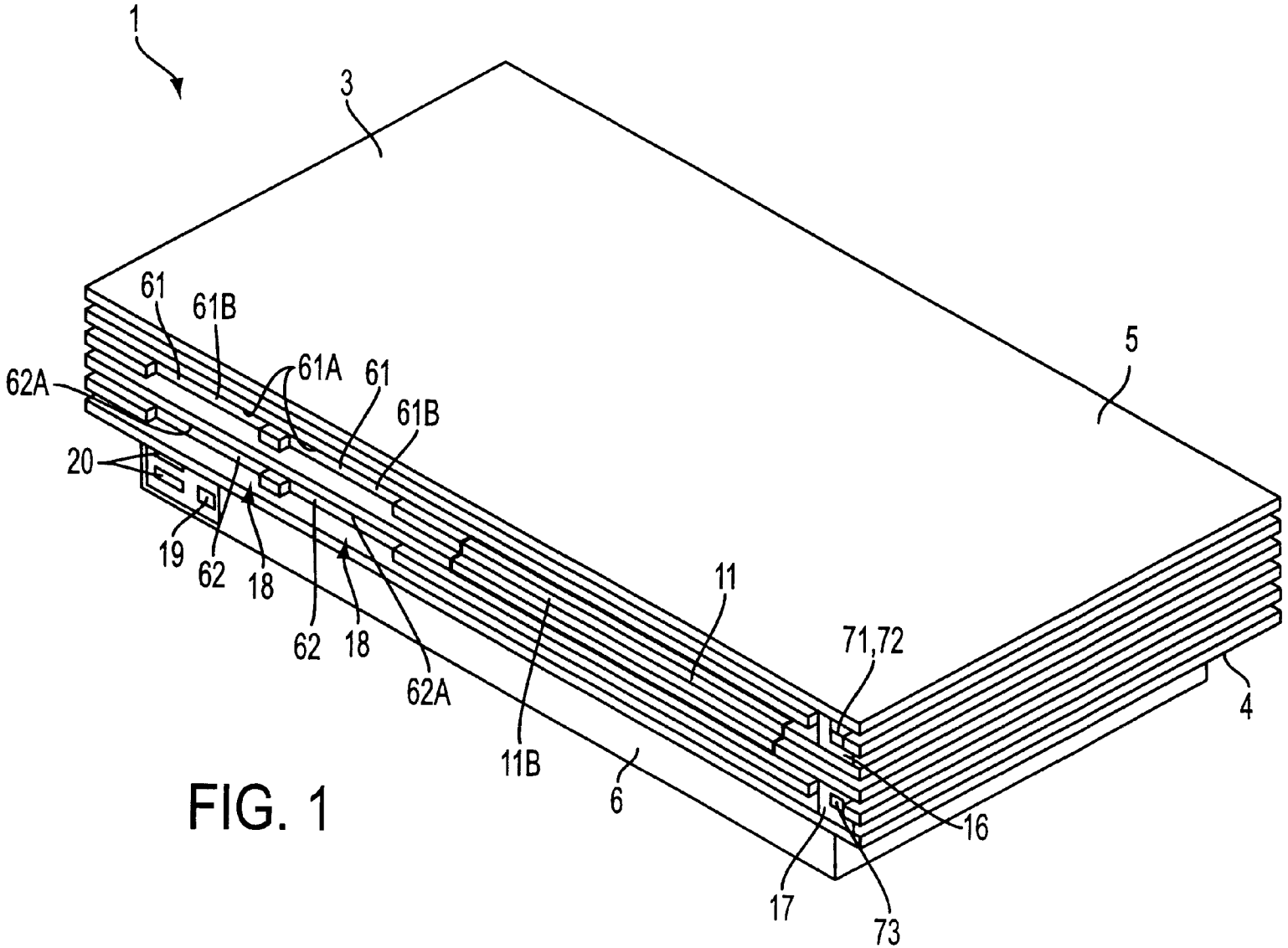
FIG. 1 is a perspective view of an entertainment device incorporating the connector of the invention.
Figure 2:
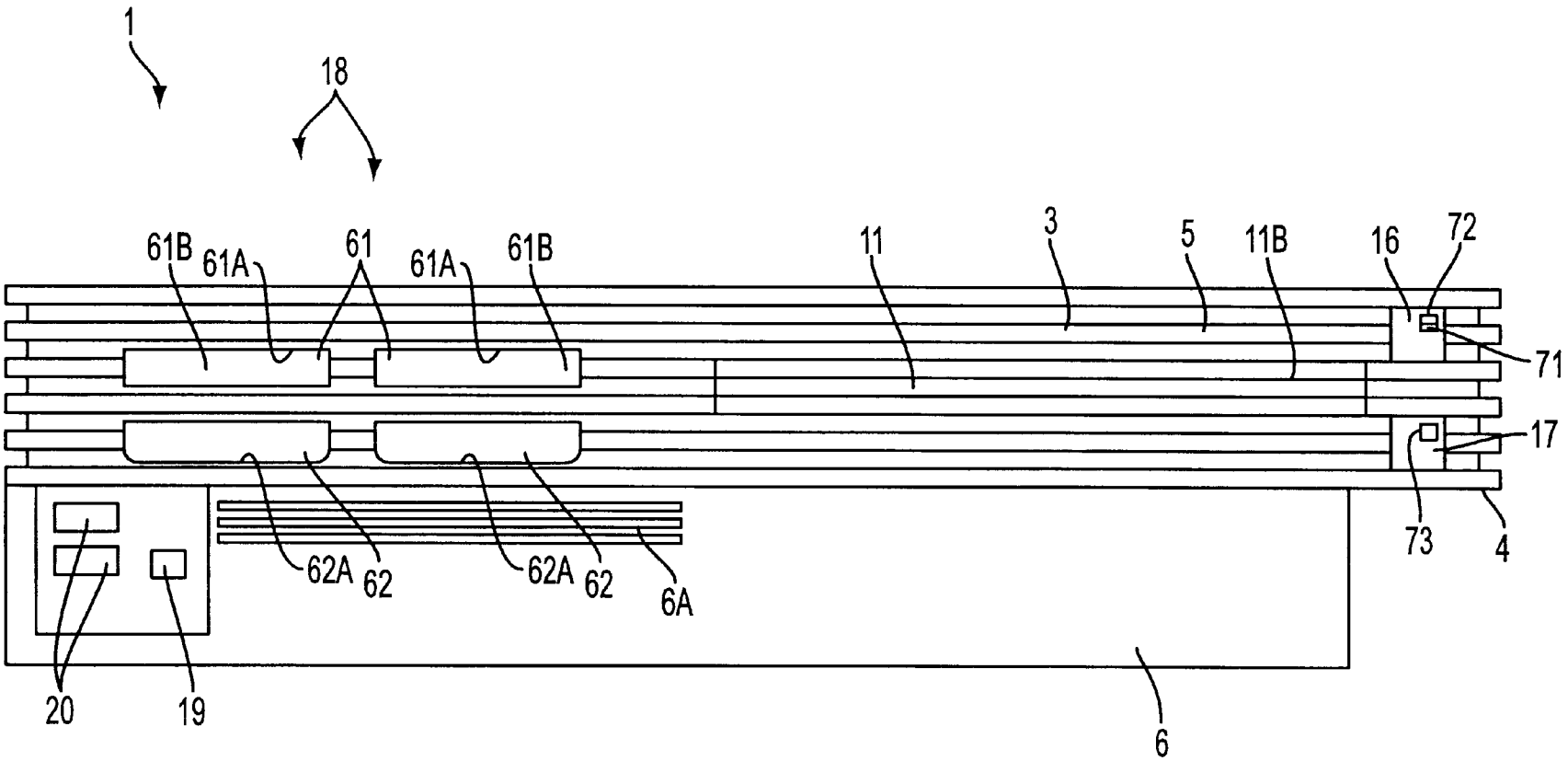
FIG. 2 is a front view of the entertainment device of FIG. 1.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

FIGS. 1 through 5 illustrate an entertainment device 1 in which is incorporated the connector of the invention. Entertainment device 1, for example, might read a game program recorded on an optical disk or other medium and executes it according to instructions from the users (i.e., game players). "Executing a game" means mainly controlling the progress of the game as well as its display and sound. Entertainment device 1 has a main body 2 housed inside a cabinet 3. Cabinet 3 has a center chassis 4, upper case 5 and lower case 6, and is preferably formed in the shape of a square on the plane and in roughly the shape of an "L" in front. The front of lower case 6 are provided with air intake openings 6A for cooling the interior of device 1. The cabinet 3 is constructed asymmetrically about center chassis 4 (see FIGS. 2 and 5) so that entertainment device 1 can be used in either horizontal or vertical orientation. If used in the horizontal orientation, the lower surface of lower case 6 contacts the floor. The left side surfaces of lower case 6 and upper case 5 are aligned so that the entertainment device 1 can be positioned in the vertical orientation.

On the front right side of upper case 5 is disk device 11, which controls the action of a CD-ROM, DVD-ROM, or other optical disk loadable into a disk tray 11B. On the right side of disk tray 11B are arranged, on top and bottom, power switch 16 and tray operation switch 17 for loading disk tray 11B into and withdrawing it from upper case 5. Provided in the center part of the surface of power switch 16 is a red LED 71 and a green LED 72, which display the status of power supply to said entertainment device 1. The red LED 71 and green LED 72 are unitized such that only one of them emits light. Provided in the center part of the surface of tray operation switch 17 is a blue LED 73, which displays the operation status of disk device 11.

On the front left side of upper case 5 are two slots 18, each having a memory card insertion unit 61 positioned at the top and a controller connection unit 62 positioned at the bottom. A memory card or other external auxiliary memory device is inserted into insertion hole 61A of memory card insertion unit 61 and shutter 61B is provided for protecting the connection terminal provided inside. Controller connection unit 62 is an input/output terminal to which is connected a connection terminal formed at the end of a controller cable that extends from a controller or operation means. The insertion hole 62A of the controller connection is formed approximately in the shape of a rectangle that is long in its horizontal direction, with the lower corners shaped rounder than the upper corners, which prevents the connection terminal of the controller from being connected in the wrong orientation. Because the shape of insertion hole 62A is given from insertion hole 61A for memory card insertion unit 61, there is no danger of inserting an external auxiliary memory device into insertion hole 62A. Having two of these controller connection units 62 makes it possible to connect two controllers, allowing two users to play competitive games, etc, and the results of operating the controller connected to each controller connection unit 62 are recorded onto an external auxiliary memory device inserted into memory card insertion unit 61.

On the front left side of lower case 6 are data transfer terminal 19 and two external device connection terminals 20. Data transfer terminal 19 conforms to the IEEE 1394 standards, and allows connection to a digital camera, video deck or the like. The two device connection terminals 20 conform to USB standards and allow connection to external devices such as a keyboard, mouse, printer, an external memory device and the like.

Figure 4:
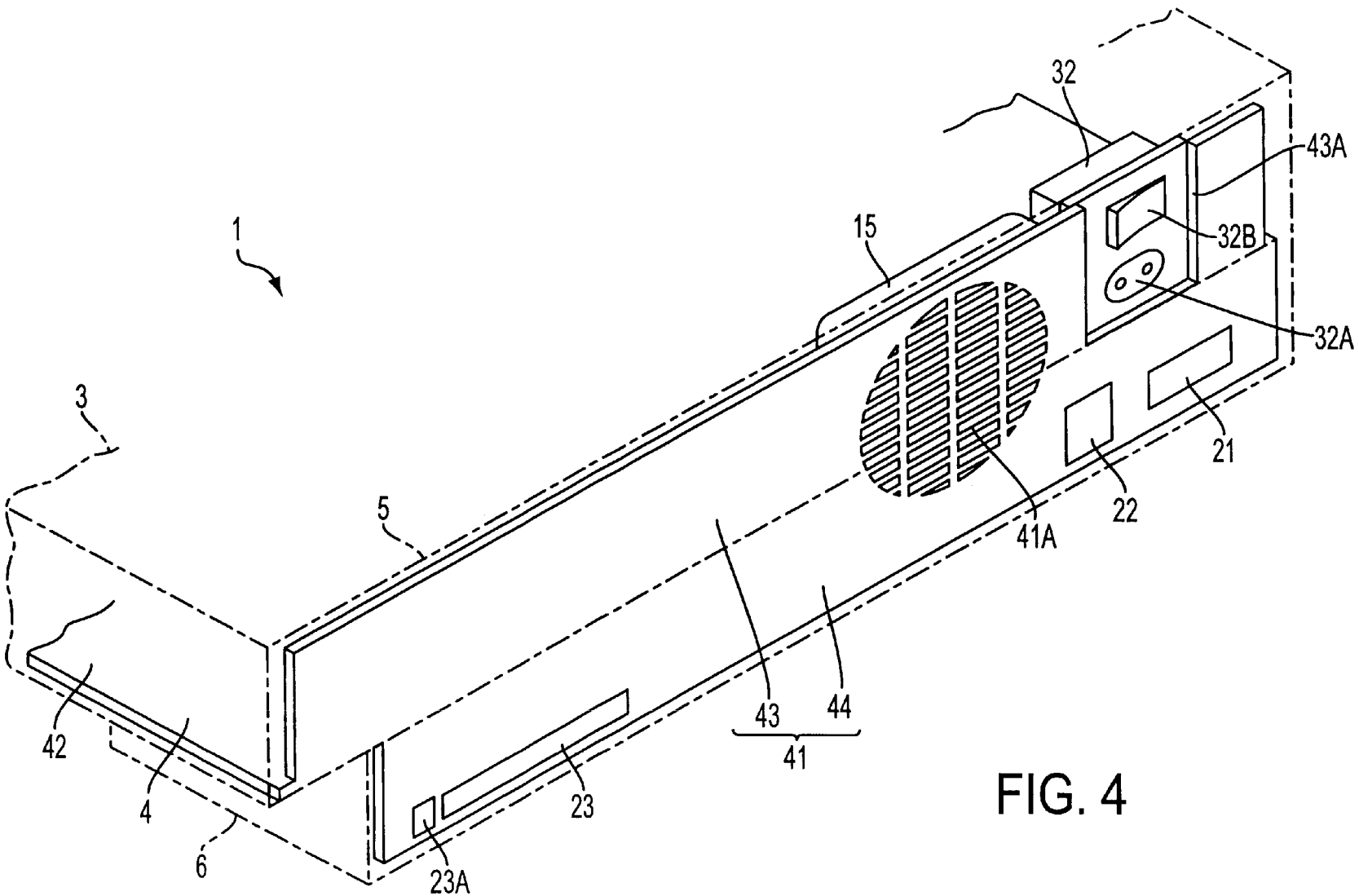
FIG. 4 is a perspective view showing the back of the entertainment device of FIG. 1.

As shown in FIG. 4, center chassis 4 has a rear surface part 41 and a middle shelf 42, which is perpendicular to rear surface part 41 in the height direction. Rear surface part 41 consists of upper rear surface part 43, which covers the rear surface of cabinet 3 and is long enough to block part of the rear surface of upper case 5, and lower rear surface part 44, which is long enough to block part of the rear surface of lower case 6. A notch 43A is formed near the right end edge of upper rear surface part 43 and is provided with a power supply terminal 32A and a main power switch 32B. A video/audio output terminal 21 is provided below notch 43A, for outputting video, audio and other signals to a television or other display device. An optical output terminal 22 is provided next to terminal 21 for outputting digital signals to external devices, while a PCMCIA slot 23 having an eject button 23A is provided on the left side of the lower rear surface part 44. Exhaust openings 41A are provided approximately in the center of rear surface part 41 through which inside air is expelled. Middle shelf 42 has approximately the same width and depth as upper case 5 and is provided at right angles at the interface part of upper rear surface part 43 and lower rear surface part 44. A notch (not shown) for accommodating exhaust fan 15 is formed in the part of middle shelf 42 in a location corresponding to exhaust openings 41 A. Arranged on the side of exhaust outlet 41A is a heat sink 54 and slots 18.

Figure 3:
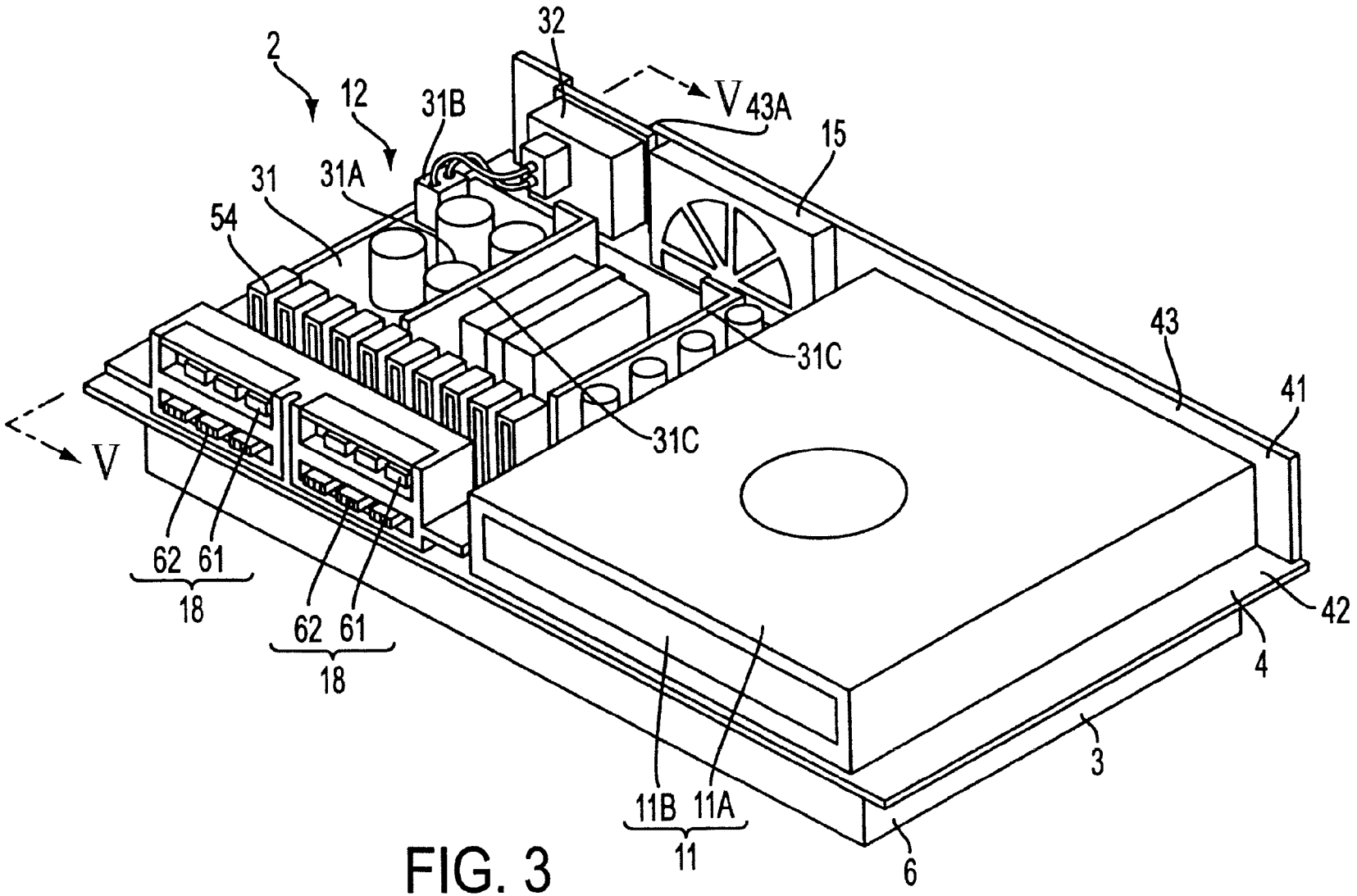
FIG. 3 is a perspective view of the internal structure of the entertainment device of FIG. 1.
Figure 5:
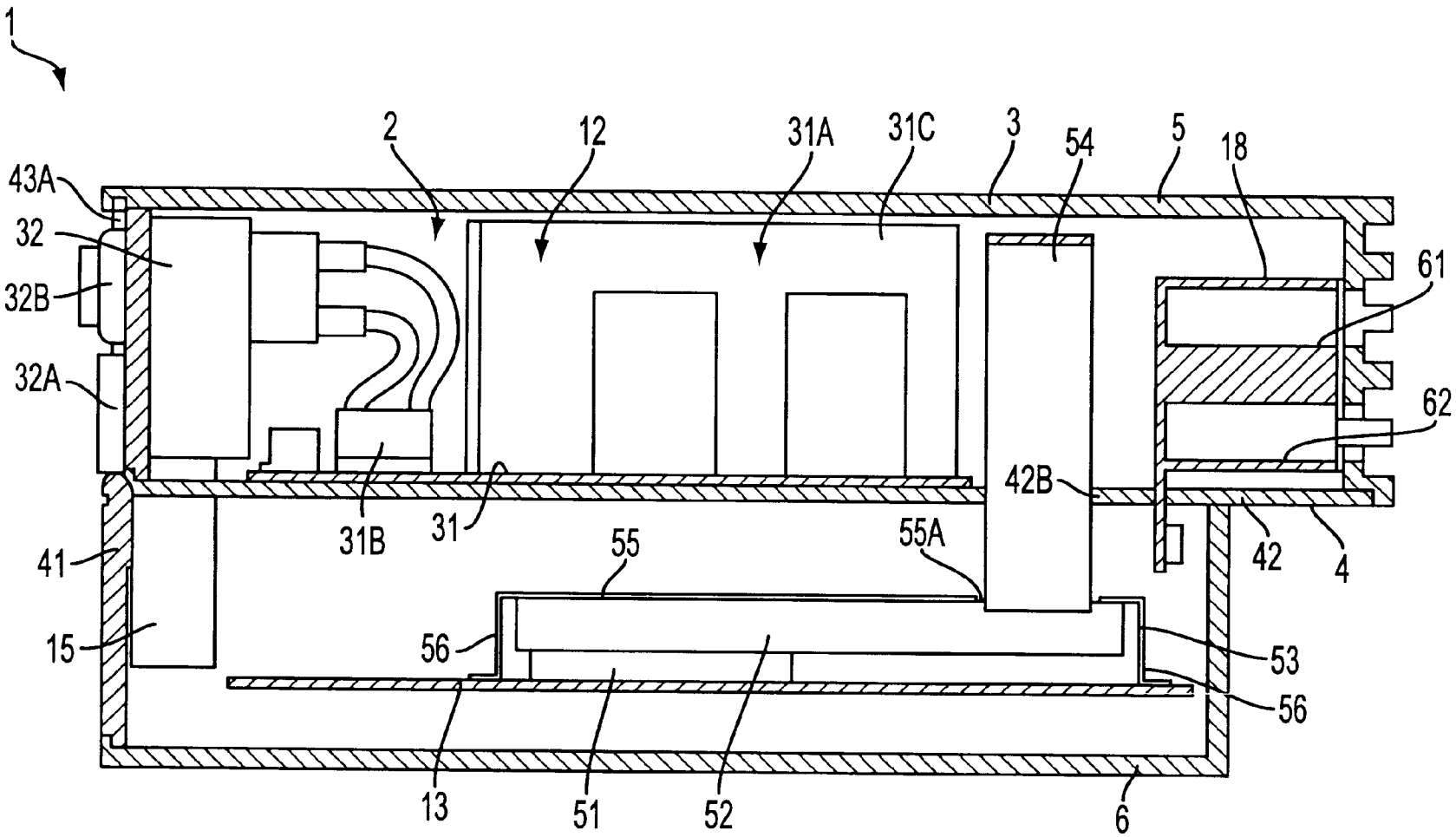
FIG. 5 is a cross section taken along line V–V in FIG. 3.

As shown in FIGS. 3 and 5, device main body 2 has a disk device 11, power source unit 12, and a main board 13 on which a calculation and processing device is mounted. Disk device 11 and power source unit 12 are arranged on middle shelf 42 and main board 13 is arranged in the space between middle shelf 42 and lower case 6. Power source unit 12 has power source circuit board 31 is mounted on middle shelf 42 of center chassis 4 and power source unit 32 into which electric power is input from an external power source. Power source unit 32 has AC inlet 32A and main power switch 32B, and is connected to power source circuit board 31 via connector 31B. Power source circuit board 31 has approximately half the plane area of middle shelf 42, and electric power supplied from an external power source is converted to DC current and to the prescribed voltage by capacitors, coils, transformers, and other circuit elements 31A that make up said power source circuit board 31. Also provided on power source circuit board 31 is a guide plate 31C for directing the flow of cooling air brought in through openings 6A and a print pattern (conductors, not shown) of voltage impression wires. In this way, power source unit 12 supplies to disk device 11 and boards 13, etc. the power that is obtained by power source circuit board 31.

Main board 13 has a control system (not shown) consisting of a CPU 51 and its peripheral devices, a graphic system (not shown) including an image processing unit that forms output images based on signals from CPU 51, a sound system (not shown) consisting of audio processing equipment that generates music and sound effects, etc., a microprocessor unit (not shown) that is a power control means that controls the supply of electric power from power source unit 12 to said control system, graphic system, and sound system, etc., an optical disk control unit (not shown) that controls the optical disk on which applications programs are recorded, and a communication control unit (not controls the input and output, etc. of signals from the controllers by which instructions are input from users, signals output to the controllers, and data from external auxiliary memory devices that record the settings of video games, etc is provided opposite the lower surface of middle shelf 42. The optical disk controller has a decoder that decodes the programs and data, etc. that are recorded with, for example, an appended error correction code (ECC), and a buffer that speeds up the reading of data from the optical disk by temporarily storing data from disk device 11. The control system has CPU 51, a peripheral device control unit that performs interrupt control and control of direct memory access (DMA) data transfers, etc., a main memory device that consists of RAM and ROM in which are stored programs such as the so-called operating system. The "main memory" here refers to the memory in which programs can be executed. CPU 51, which controls entertainment device 1 as a whole by executing the operating system, consists of, for example, a 128 bit RISC CPU. The graphic system has an image processing device that renders pictures under drawing instructions from CPU 51, and a frame buffer in which images rendered by this image processing device are stored. The image processing device draws polygons, etc. to the frame buffer in accordance with drawing commands from CPU 51, and is able to draw up to about 75 million polygons per second. The sound system has an audio processing unit that plays background music and sound effects, etc. under instructions from CPU 51, and a sound buffer in which waveform data, etc. is stored by this audio processing unit.

Attached to the top of CPU 51 and the image processing unit is heat conducting member 52, which is preferably made of high thermal conductivity aluminum. CPU 51, the image processing unit, and heat conducting member 52 are covered by shielding member 53, which is preferably made of metal and consists of flat shielding part 55, which comes into contact with the upper surface of heat conducting member 52, and side shielding parts 56 extending from both ends of flat shielding part 55 to the upper surface of main board 13. Shielding member 53 prevents outside disturbances such as noise generated from power source unit 12 from intruding into CPU 51. Provided on heat conducting member 52 is a temperature sensor (not shown), which detects the temperature of CPU 51 and the image processing unit. The temperature sensor has a sensor unit that detects the temperature of heat conducting member 52 and a signal conversion unit that converts the detected temperature to a temperature detection signal, which is output to the microprocessor unit. The microprocessor unit controls the supply of electric power from power source unit 12 to CPU 51 and the image processing unit of main board 13 based on temperature abnormality detection signals from said temperature sensor. Heat sink 54 is provided on the upper surface of the end of heat conducting member 52, spans CPU 51 and the image processing unit via heat conducting member 52 and extends from the upper surface of heat conducting member 52 to near the top of upper case 5. Thus, as shown in FIG. 5, openings 42B, 55A are formed in middle shelf 42 and flat shielding part 55 in positions corresponding to the location of heat sink 54.

Electrically connected to the communication control unit is one end of the slots 18 consisting of controller connection unit 62 and memory card insertion unit 61, as well as data transfer terminal 19, external device connection terminal 20, communication terminal 22, and PCMCIA slot 23, etc., by which said communication control unit also controls the input and output of signals with external devices, etc. connected to and inserted into these terminals, etc.

Figure 6:
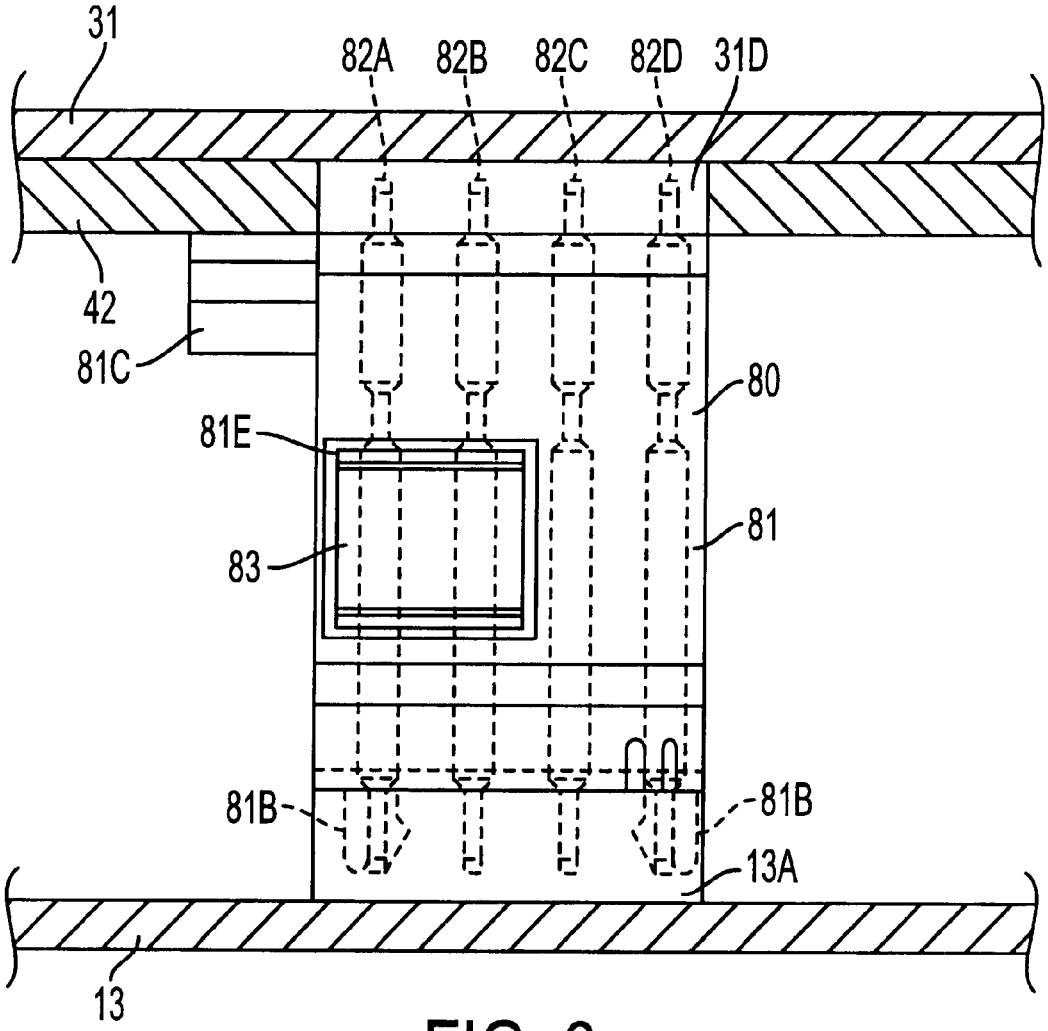
FIG. 6 is an enlarged view showing the connector of the present invention.
Figure 7A:
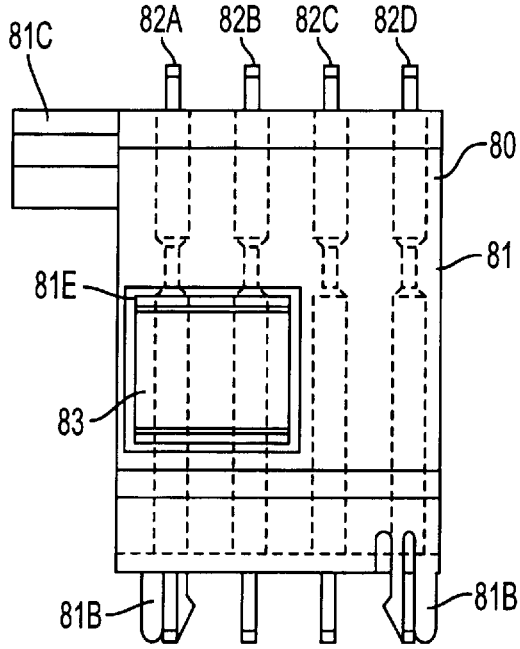
FIG. 7A is a front view.
Figure 7B:
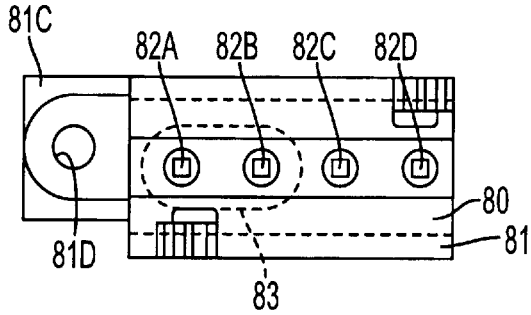
FIG. 7B is a plan view and FIG. 7C is a cross-sectional view of the connector of the present invention.
Figure 7C:
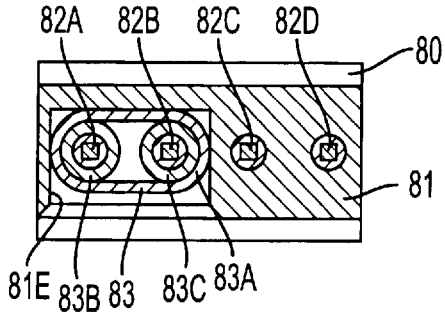
Figure 8:
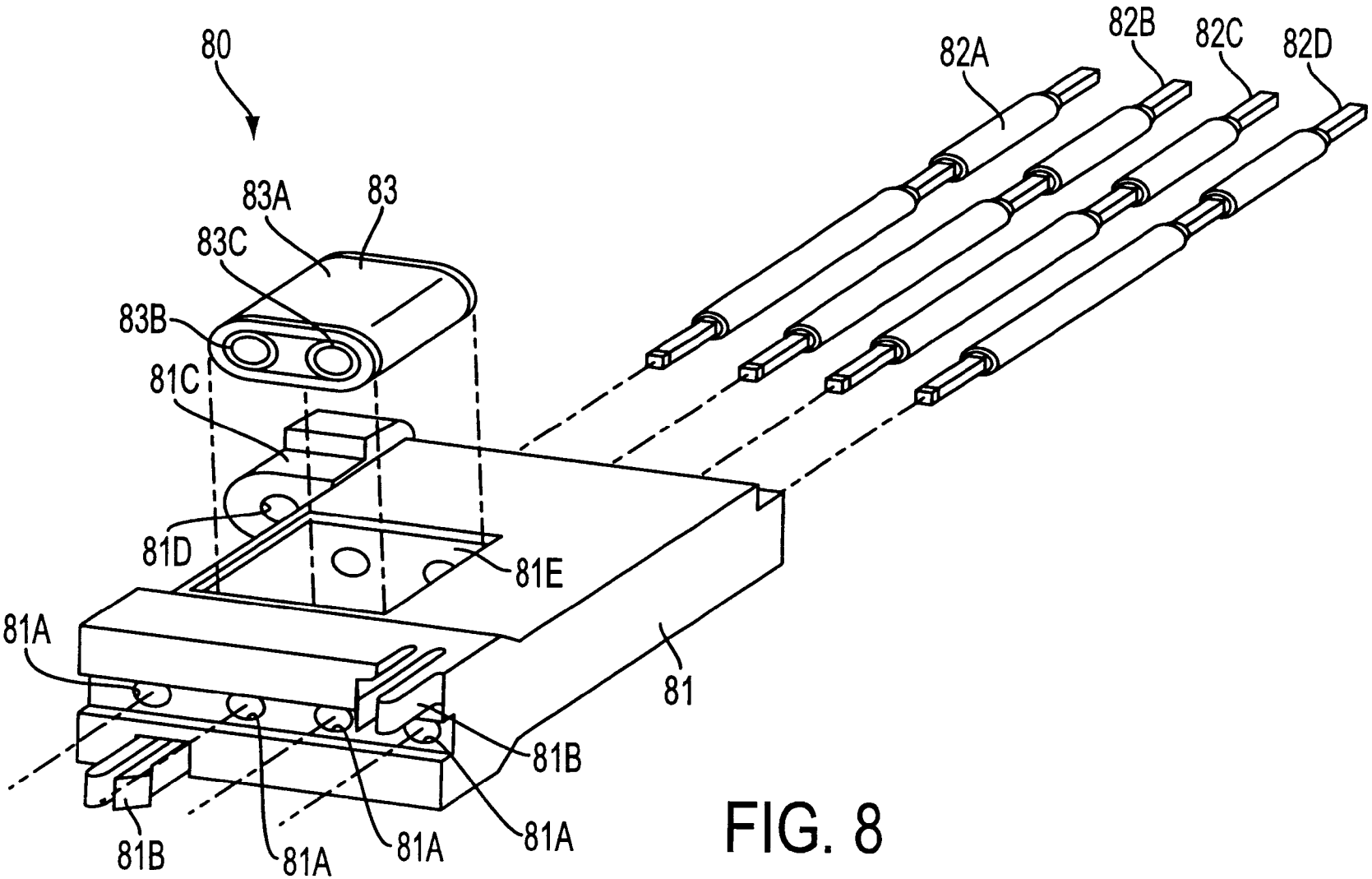
FIG. 8 is an exploded perspective view of the connector of the invention.

As shown in FIG. 6, DC electric power transformed to the prescribed voltage by power source circuit board 31 is supplied to main board 13 through connector 80. One end of connector 80 is connected to a first connection 31D attached to the lower surface of power source circuit board 31, and the other end is connected to a second connection 13A attached to main board 13. Provided on first connection 31D and second connection 13A are terminals (not shown) that are connected to the print patterns (not shown) formed on power source circuit board 31 and on main board 13, respectively.

More specifically, as shown in FIGS. 7A–7C and 8, connector 80 comprises an insulating housing 81 formed by a flexible resin molding, four signal transmission members 82A–82D inserted through holes 81A in housing 81 and electrically connect print patterns formed on power source circuit board 31 and on main board 13, and a ferrite core 83 provided inside said housing 81. Transmission members 82A–82D are arranged parallel in a direction perpendicular to the direction in which they are inserted through insulating housing 81. In order to allow DC electric power to flow that is transformed to the prescribed voltage by power source circuit board 31, of the four signal transmission members 82A–82D, two signal transmission members 82A, 82B are made into voltage impression wires on which a DC voltage is impressed, and the other two signal transmission members 82C, 82D are made into grounding wires. That is, connector 80 is a connector for a DC power source.

The ferrite core 83 is inserted into housing 81 through a concave core insertion part 81E, which is formed by cutting out the side of insulating housing 81. Formed at one end of insulating housing 81 are hole 81D and anchoring part 81C, whose upper surface makes contact with the lower surface of middle shelf 42. Two engaging parts 81B that engage with second connection 13A are formed on the end face of the other end of insulating housing 81 in a position where they form diagonal braces with signal transmission members 82A–82D interposed between them. An insertion through-hole and a female threaded part (not shown) are formed opposite said hole 81D in middle shelf 42 and power circuit board 31. With them, by inserting a bolt from the lower surface side of anchoring part 81C and screwing said bolt into the female threaded part of power circuit board 31, connector 80 is secured to power circuit board 31 via middle shelf 42.

Ferrite core 83, which is a multi-layer structure, has outer shell part 83A and two insert-through parts 83B, 83C, which are formed inside outer shell part 83A. Outer shell 83A is formed in a roughly cylindrical shape whose width is about half the width of insulating housing 81, and is inserted into said concave part 81E. Signal transmission members 82A, 82B, which are inserted through hole 81A of insulating housing 81, pierce these insert-through parts 83B, 83C and are therefore partitioned one by one via said insert-through parts 83B, 83C. By causing the two signal transmission members 82A, 82B that constitute the voltage impression wires to pierce ferrite core 83, EMI measures are taken on said signal transmission members 82A, 82B. And by not interposing ferrite core 83 between signal transmission members 82C, 82D that constitute the grounding wires, one makes uniform the standard electric potentials of the print patterns of the grounding wires formed on power source circuit board 31 and main board 13, which are connected by signal transmission members 82C, 82D.

In order to manufacture connector 80, the insulating housing 81 is first provided with through-holes 81 A and concave part 81E. After inserting ferrite core 83 into concave part 81E by dropping it in, signal transmission members 82A–82D are inserted through insertion through-holes 81A of said insulating housing 81, with transmission members 82A and 82B piercing through parts 83B and 83C of ferrite core 83 and transmission members 82C and 82D not piercing through ferrite core 83. By connecting the two ends of connector 80 to first connection 31D and second connection 13A, respectively, and causing the two end parts of signal transmission members 82A–82D to make contact with such the terminals in such connections, electric power transformed to the prescribed voltage by power source circuit board 31 is supplied to main board 13. That is, connector 80 is a board-to-board connector in which main board 13 and power source circuit board 31 arranged opposite each other are physically connected, and print patterns formed on main board 13 and on power source circuit board 31 are electrically connected to each other.

Thus, when connector 80 is manufactured, it is easy to just insert ferrite core 83 into concave part 81E of insulating housing 81, which simplifies manufacturing of connector 80 as compared with the prior art. Also, because only certain transmission members pierce ferrite core 83, it is possible to take EMI measures only for the parts on which a voltage is impressed. That is, by not interposing the ferrite core between the grounding wires, ferrite core 83 can be prevented from acting as an impedance element on the grounding wires, and by connecting the print patterns of the grounding wires formed on main board 13 and on power source circuit board 31, the standard electric potentials can be made uniform.

In addition, because insulating housing 81 is formed by a resin molding that has flexibility, the insertion of the signal transmission members 82A–82D through the housing 81 is easier. Also, because concave part 81E is formed with a concave cross-section along the insert-through direction of the signal transmission members, and the inside base surface of said concave part 81E is made the support surface of inserted ferrite core 83, said ferrite core 83 can be arranged in its prescribed position just by dropping ferrite core 83 into concave part 81E. In addition, because anchoring part 81C is provided on insulating housing 81, said connector 80 is firmly secured to power source circuit board 31, and even if the connection part between power source circuit board 31 and connector 80 is subjected to a large vibration, etc., the connection can hold firmly without connector 80 becoming loose, thereby making it possible to have a firm electrical connection between connector 80 and power source circuit board 31. Furthermore, the insertion of the signal transmission members through the ferrite core acts to fix the ferrite core within the insulated housing and also acts to stabilize the entire construction of the connector, thereby making it difficult to break apart even if outside force is applied.

While the invention has been described with respect to a preferred embodiment, alternative constructions are contemplated. For example, while the anchoring part is described on the side of power source circuit board 31 of insulating housing 81; it may also be provided, for example, on the side of main board 13, or it may be dispensed with altogether provided that connector 80 does not totter unsteadily even if a large vibration, etc. is applied to the connection part between power source circuit board 31 and connector 80.

In addition, the insulated housing 81 may be provided without the ferrite core, in which case all the four signal transmission members exposed and the connector may be used even as a connector for an AC power source. Also, the core insertion part is not limited to being of concave cross-section, for its shape, etc. may be determined appropriately as long as it can accommodate a core which can be pierced by signal transmission members. Also, the connector may be used to connect print patterns or circuit elements in addition to boards. In addition, the signal transmission members may consist of other wires such as voltage impression wires, grounding wires, and control signal wires.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A connector comprising:

a) an insulated housing;

b) a plurality of signal transmission members inserted through said insulated housing along a first direction, some of said signal transmission members being electrically connected to each other; and c) a filter insertion part formed by making a cutout through a surface of said insulated housing and adapted to receive a filter therein along an insertion direction that is perpendicular to said first direction and through which at least one, but not all signal transmission members extend.

2. A connector in accordance with claim 1, further comprising an EMI (Electromagnetic Interference) filter inserted into said filter insertion part.

3. A connector in accordance with claim 2, wherein said EMI filter is a ferrite core.

4. A connector in accordance with claim 2, wherein said filter insertion part has a concave cross sectional shape.

5. A connector in accordance with claim 1, wherein said filter insertion part is dimensioned for the extension of only two signal transmission members therethrough.

6. A connector in accordance with claim 2, wherein said EMI filter further comprises an outer shell and at least one through-part, said outer shell dimensioned to be dropped into said filter insertion part, said at least one through-part adapted for the extension of one signal transmission member of said plurality.

7. A connector in accordance with claim 1, wherein said insulated housing is formed from a flexible molding.

8. A connector in accordance with claim 7, wherein said flexible molding is a flexible resin molding.

9. A method of manufacturing a connector comprising the steps of:

a) providing an insulated housing and a plurality of signal transmission members;

b) making a cutout through a surface of said insulated housing;

c) inserting an EMI (Electromagnetic Interference) filter into said insulated housing through said cutout;

d) inserting said plurality of signal transmission members through said insulated housing along a second direction relative to said insulated housing, said second direction being different than said first direction, such that at least one transmission member also extends through said EMI filter and at least one transmission member does not also extend through said EMI filter.

10. A method in accordance with claim 9, wherein said EMI filter is a ferrite core.

11. A method in accordance with claim 9, wherein said EMI filter is inserted into said insulated housing in a direction that is perpendicular to the direction of insertion of said signal transmission members through said insulated housing.

12. A method in accordance with claim 10, wherein said EMI filter further comprises an outer shell and at least one through-part, said outer shell dimensioned to be dropped through said cutout, said at least one through-part adapted for the extension of one signal transmission member of said plurality.

13. A method in accordance with claim 10, wherein said signal transmission members are arranged parallel to each other in a direction that is perpendicular to the direction in which said EMI filter is inserted into said insulated housing.

14. A method in accordance with claim 10, wherein said insulated housing is formed from a flexible molding.

15. A method in accordance with claim 14, wherein said flexible molding is a flexible resin molding.

* * * * *